US006422829B1

(12) United States Patent
Schütz

(10) Patent No.: US 6,422,829 B1
(45) Date of Patent: Jul. 23, 2002

(54) COMPOUND PUMP

(75) Inventor: Günter Schütz, Köln (DE)

(73) Assignee: Leybold Vakuum GmbH (DE)

( * ) Notice: Subject to any disclaimer, the term of this patent is extended or adjusted under 35 U.S.C. 154(b) by 0 days.

(21) Appl. No.: 09/508,451

(22) PCT Filed: Sep. 4, 1998

(86) PCT No.: PCT/EP98/05611

§ 371 (c)(1),
(2), (4) Date: Mar. 9, 2000

(87) PCT Pub. No.: WO99/15793

PCT Pub. Date: Apr. 1, 1999

(30) Foreign Application Priority Data

Sep. 24, 1997 (DE) ..... 297 17 079 U

(51) Int. Cl.[7] ..... F04B 23/14; F01D 1/36

(52) U.S. Cl. ..... 417/203; 417/205; 417/244; 415/90

(58) Field of Search ..... 417/203, 205, 417/244; 415/90

(56) References Cited

U.S. PATENT DOCUMENTS 4,954,047 A * 9/1990 Okuyama et al. ..... 417/203
5,513,951 A * 5/1996 Komoda et al. ..... 416/223 R X
5,681,146 A * 10/1997 White ..... 416/223 R

FOREIGN PATENT DOCUMENTS

| | | | |
|---|---|---|---|
| DE | 39 32 228 | | 4/1990 |
| DE | 196 32 874 | | 2/1998 |
| EP | 0 142 208 | | 5/1985 |
| FR | 2280809 | | 2/1976 |
| GB | 2232205 | * | 7/1989 |
| JP | 60-125795 | * | 7/1985 |
| WO | 89 06319 | | 7/1989 |
| WO | 93 23672 | | 11/1993 |

* cited by examiner

*Primary Examiner*—Charles G. Freay
*Assistant Examiner*—Michael K. Gray
(74) *Attorney, Agent, or Firm*—Wall, Marjama & Bilinski, LLP

(57) ABSTRACT

The invention relates to a friction vacuum pump (1) containing at least one turbomolecular pump stage (6, 7), a screw pump stage (11, 12) connected to the delivery side of the pump, and a filling stage (24) arranged between the turbomolecular pump stage (6, 7) and the screw pump stage (11, 12). According to the invention it is proposed that said filling stage (24) be configured as a centrifugal stage in order to simplify the construction thereof.

7 Claims, 2 Drawing Sheets

COMPOUND PUMP

BACKGROUND OF THE INVENTION

The present invention relates to a friction vacuum pump containing at least one turbomolecular pump stage, a screw pump stage connected on the delivery side of the pump, and a filling stage arranged between the turbomolecular pump stage and the screw pump stage.

In turbomolecular pumps with downstream screw pump stages, which are also called compound pumps, the pumped gas needs to be transferred from a pump chamber having a relatively large volume in which the axial compressor stages are located, into a pump chamber (pumping slot) having a relatively small volume in which the screw is located. Known designs for this transitional area have the disadvantage that the flow will breakdown. This will significantly impair the pumping capacity of the pump.

From DE-A-196 32 874 it is known to provide between the turbomolecular pump stage and the downstream screw pump stage, a filling stage which is equipped with blades. The production of such an intermediate stage is involved. Moreover, the presence of the blades will hamper assembly.

SUMMARY OF THE INVENTION

It is the task of the present invention to considerably simplify the design of the filling stage without impairing the effective supply of gas into the screw pump stage.

This task is solved through the present invention by designing the filling stage as a centrifugal stage. Components of the centrifugal stage are rotating ridges which are located at the level of the intake area of the screw pump stage. The centrifugal pump has the effect of deflecting and compressing the gas ejected by the turbomolecular pump stage and supplying the gas into the pump chamber of the screw pump. The gas flow is substantially continuous so that the flow will no longer breakdown thereby impairing operation.

Owing to the fact that the centrifugal stage deflects the gas flow outwards, there exists the possibility of selecting a relatively large diameter for the pumping slot of the screw pump stage, so that the rotating pumping surface of the screw pump stage has a high circumferential speed.

If the inside diameter of the stator at the outside of the screw pump stage is greater than the outside diameter of the rotor of the turbomolecular pump stage, then there exists, provided that the stator of the turbomolecular pump consists of spacing rings and blade half-rings in a basically known manner, the possibility of being able to assemble or disassemble the stator of both pump stages without the need to assemble resp. disassemble the rotor of the turbomolecular pump stage. These dimensions will allow the rotary system of the compound pump to be balanced first, followed by subsequent assembly of the stator components.

BRIEF DESCRIPTION OF THE DRAWINGS

Further advantages and details of the present invention shall be explained with reference to the design examples depicted in drawing FIGS. 1 to 5. Depicted in drawing

Figure 1:
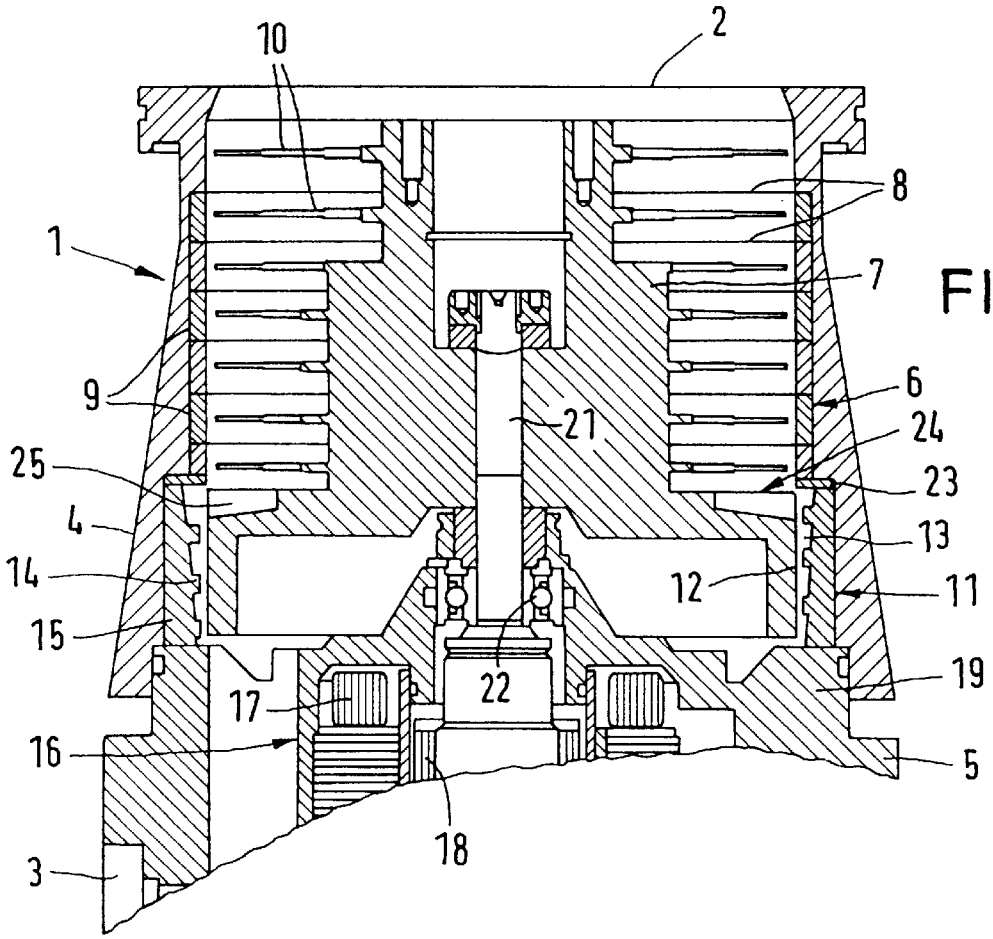
FIG. 1 is a partial longitudinal sectional view through a design example for a friction vacuum pump according to the present invention and FIGS. 2, 3, 4 and 5 top views on different variants for the centrifugal stage.
Figure 2:
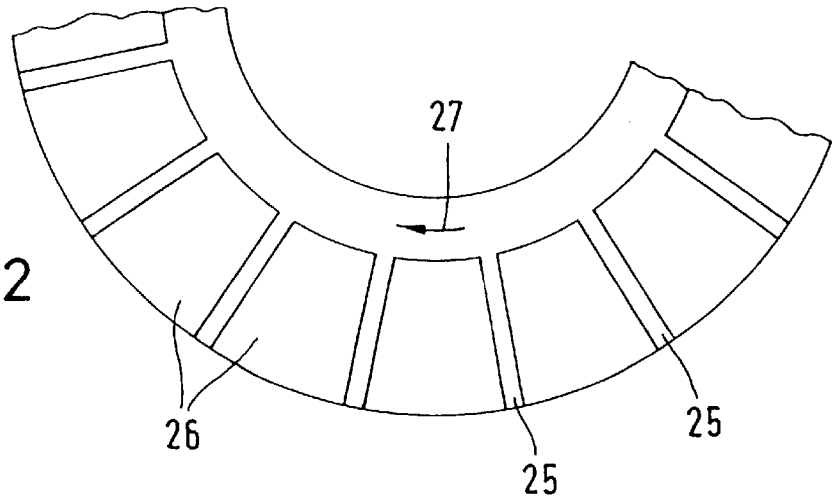
Figure 3:
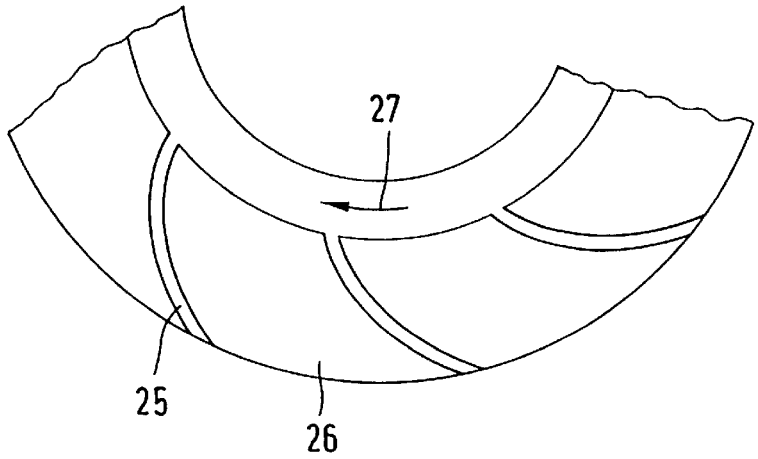
Figure 4:
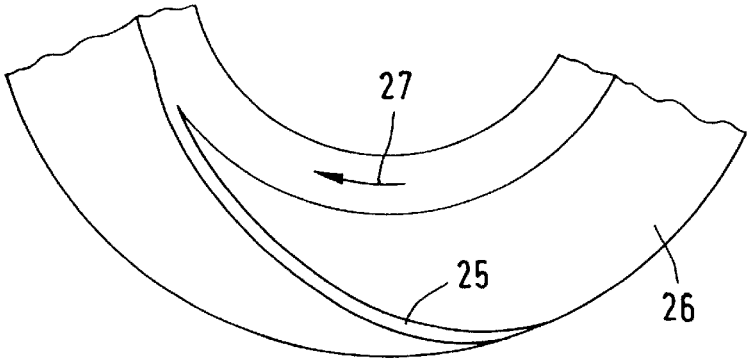
Figure 5:
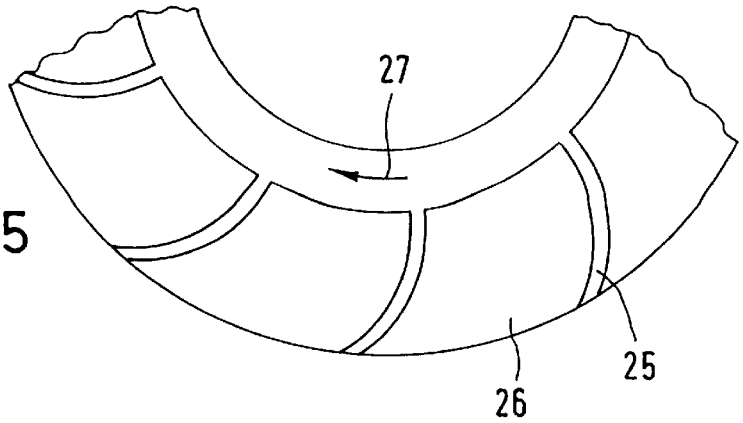

In the design example according to drawing FIG. 1, the pump itself is designated as 1, its inlet with 2 and its discharge with 3. The housing of the pump comprises the two sections 4 and 5.

DESCRIPTION OF THE INVENTION

Housing section 4 embraces the stator 6 and the rotor 7 of the turbomolecular pump stage. The stator 6 comprises the only schematically indicated blade half-rings 8 as well as spacing rings 9, which together form a self-centering stator pack. The rotor 7 is equipped with rotor blades 10.

Housing section 4 also embraces the stator 11 and the rotor 12 of the screw pump stage, the pumping chamber or slot of which is designated as 13. The thread 14 of this stage may be arranged on the side of the stator or the rotor. In the case of the depicted design example it is arranged on the side of the stator and is part of a stator sleeve 15 which may be fitted independently of the housing section. The rotor 7 of the turbomolecular pump stage 7, 8 and the rotor 12 of the screw pump stage 11, 12 are components of a jointly rotating system 7, 12. The rotor 12 and the screw pump stage 11, 12 form the end of this system on the delivery side and may be designed as a disk or bell-shaped (as depicted in drawing FIG. 1).

Housing section 5 embraces the drive motor 16, the stator of which is designated as 17 and its rotor as 18. Housing section 5 is part of a chassis 19 with an internal chamber, in which the drive motor 16 and further components are located. Also located in chassis 19 are the bearings for the shaft 21 carrying the rotors 7 and 12 of the compound pump. Only the upper bearing 22 is depicted. Moreover, the chassis 19 is the carrier for all further components of pump 1.

In the assembled state of pump 1 the housing sections are linked to each other. The stator sleeve 15 is supported by chassis 19. The inside diameter is slightly greater than the outside diameter of rotor 7 of the turbomolecular pump stage so that the stator sleeve 15 may be disassembled after having removed housing section 4 and with disassembled stator 6 of the turbomolecular pump stage 6, 7. Thus there exists the possibility of being able to assemble all stator components 8, 9, 15 after assembly of the rotating system 7, 12 and also after balancing it.

Placed on the face side of stator sleeve 15 at the intake side is an impeller 23, the inside rim of which corresponds to the inside diameter of the spacing rings 9. In the assembled state of the pump, the stator pack 6 is supported by the impeller 23.

Located between the turbomolecular pump stage 6, 7 and the screw pump stage 11, 12 is a filling stage which is designed as a centrifugal stage 24. It comprises ridges 25 which extend basically radially towards the outside, these ridges forming pockets 26 facing the last row of rotor blades. Various design implementations of the centrifugal stage 24 are depicted in drawing FIGS. 2 to 5. Located between the ridges 25 are the pockets 26, said pockets being open towards the top and the outside. The arrow 27 indicates in each case the direction of rotation.

In the design example presented, the centrifugal stage 24 is part of the rotor 12 of the screw pump stage. Said centrifugal stage is arranged on the side facing the blades 10 of the turbomolecular pump stage 7, 10 of the disk or bell-shaped rotor 12.

The depth of the pockets 26 may increase radially towards the outside (drawing FIG. 1). Their location is so selected that the peripheral openings of the pockets 26 are arranged at the level of the inlet of the screw pump stage 11, 12. In the design implementation according to drawing FIG. 2, the ridges extend radially. In the design implementations according to drawing FIGS. 3 and 4, the ridges 25 are inclined backwards with respect to the direction of rotation 27, and in the design implementation according to drawing FIG. 5 they are inclined to the front. The discharge angle of the ridges (blade of the centrifugal stage) defines the static and dynamic share in the pressure level. If the ridge bends backwards, a high static share will result. Moreover, the degree of deflection in the circumferential direction is increased by a backwards bend. If the ridge bends forwards, a high dynamic share will result.

From drawing FIG. 1 it is also apparent that the radial dimensions of the pockets 26 substantially correspond to the active pumping lengths of the blades 10 of the last row of rotor blades located on the delivery side. In the centrifugal stage 24, the gases leaving the turbomolecular pump stage are deflected, owing to the effect of the ridges 26 and pockets 27, specifically in the direction of the pumping slot 13 of the screw pump stage 11, 12. At the same time a compression is effected so that flow breakdowns are largely avoided.

What is claimed is:

1. A compound vacuum pump assembly that includes:

a turbomolecular pump stage having an inlet for delivering a fluid into the pump assembly and an outlet section, a centrifugal pump stage; and a screw pump stage having an inlet and an outlet for discharging fluid from the assembly;

said stages being aligned in a series along a common axis and sharing a common rotor;

said screw pump stage containing a stator and said inlet of said screw pump stage being located adjacent to said outlet of said turbomolecular pump stage and;

said centrifugal pump stage having an impeller mounted upon said rotor that is positioned inside the stator of said screw pump stage at the inlet to said screw pump stage, said impeller having radially extended blades that form radially extended pockets facing the outlet of said turbomolecular pump stage and being arranged to turn the fluid leaving the turbomolecular pump radially into the inlet of the screw pump stage.

2. The pump assembly of claim 1 wherein the turbomolecular pump stage contains a stator having a diameter that is smaller than the diameter of the screw pump stage stator.

3. The pump assembly of claim 1 wherein the rotor sections of each pump stage are integrally joined.

4. The pump assembly of claim 1 wherein said pockets expand radially toward the outer periphery of the impeller.

5. The pump assembly of claim 1 wherein said blades curve forwardly with respect to the direction of rotation of said impeller.

6. The pump assembly of claim 1 wherein said blades curve rearward with respect to the direction of rotation of said impeller.

7. The pump assembly of claim 1 wherein said impeller is integral with said rotor.

* * * * *